US009609927B2

(12) United States Patent
Whichel

(10) Patent No.: US 9,609,927 B2
(45) Date of Patent: Apr. 4, 2017

(54) ABBREVIATED WALLET DEVICE

(71) Applicant: WOBO Wallet, LLC, Harrisburg, NC (US)

(72) Inventor: Brent Andrew Whichel, Harrisburg, NC (US)

( * ) Notice: Subject to any disclaimer, the term of this patent is extended or adjusted under 35 U.S.C. 154(b) by 0 days.

(21) Appl. No.: 14/837,823

(22) Filed: Aug. 27, 2015

(65) Prior Publication Data

US 2016/0073747 A1 Mar. 17, 2016

Related U.S. Application Data

(60) Provisional application No. 62/049,602, filed on Sep. 12, 2014.

(51) Int. Cl.

| | |
|---|---|
| ***A45C 1/06*** | (2006.01) |
| ***A45C 13/36*** | (2006.01) |
| ***A45C 13/00*** | (2006.01) |
| ***A45C 13/30*** | (2006.01) |
| ***A45C 13/02*** | (2006.01) |

(52) U.S. Cl.

CPC ..... *A45C 1/06* (2013.01); *A45C 13/005* (2013.01); *A45C 13/02* (2013.01); *A45C 13/30* (2013.01); *A45C 13/36* (2013.01); *A45C 2001/062* (2013.01); *A45C 2001/065* (2013.01); *A45C 2001/067* (2013.01)

(58) Field of Classification Search

CPC ..... A45C 1/06; A45C 11/182
USPC ..... 150/131, 134, 136, 137, 147–149; 206/39.4; 281/19.1

See application file for complete search history.

(56) References Cited

U.S. PATENT DOCUMENTS

| | | | | | |
|---|---|---|---|---|---|
| 773,392 | A * | 10/1904 | Holsappe | A45C 1/06 | 150/137 |
| 807,648 | A * | 12/1905 | Wiggins | B42D 5/005 | 150/147 |
| 1,260,699 | A * | 3/1918 | Morris | B42D 5/005 | 281/19.1 |
| 1,613,380 | A * | 1/1927 | Broomhall | B42F 9/00 | 150/147 |
| 2,317,748 | A * | 4/1943 | Exline | B42D 5/022 | 281/19.1 |
| 5,275,217 | A * | 1/1994 | Eakin | A45C 1/06 | 150/132 |
| 5,533,656 | A | 7/1996 | Bonaldi | | |
| 5,653,276 | A | 8/1997 | Niernberger | | |
| 5,944,080 | A | 8/1999 | Podwika | | |

(Continued)

*Primary Examiner* — Sue A Weaver

(74) *Attorney, Agent, or Firm* — PatentFile, LLC; Bradley C. Fach; Steven R. Kick

(57) ABSTRACT

An abbreviated wallet device may comprise a foldable element with a first half comprising a proximal end and a distal end and a second half comprising a proximal end and a distal end. A lock tab may be coupled to the second half of the foldable element, and the lock tab may be disposed generally parallel to the second half of the foldable element. A hinge may couple the proximal end of the first half to the proximal end of the second half, and the hinge may be configured to allow the distal end of the first half to pivot relative to the distal end of the second half. A band may be slidably coupled to the first half of the foldable element, and the band may be movable between a first position proximate to the hinge and a second position proximate to the distal end of the first half.

17 Claims, 12 Drawing Sheets

(56) References Cited

U.S. PATENT DOCUMENTS

| | | | | |
|---|---|---|---|---|
| 6,357,084 | B1 | 3/2002 | Haidon | |
| 6,823,910 | B1 | 11/2004 | Elnekaveh | |
| 7,640,632 | B2 | 1/2010 | Lazarus | |
| 2004/0172789 | A1 | 9/2004 | Lehr | |
| 2010/0065171 | A1* | 3/2010 | Uzelac | A45C 11/182 150/149 |
| 2013/0056119 | A1* | 3/2013 | Henriette | A45C 11/182 150/137 |
| 2013/0276943 | A1 | 10/2013 | Minn et al. | |

* cited by examiner

ABBREVIATED WALLET DEVICE

CROSS REFERENCE TO RELATED APPLICATIONS

This application claims priority to and the benefit of the filing date of U.S. Provisional Application No. 62/049,602, filed on Sep. 12, 2014, entitled "Tab and Band system used to carry currency, cards, and other items typically found in a wallet or money clip", which is hereby incorporated by reference in its entirety.

FIELD OF THE INVENTION

This patent specification relates to the field of devices for securing and carrying currency, credit cards, and other items. More specifically, this patent specification relates to devices and apparatuses that facilitate the storage and organization currency, cards, and other items typically associated with a wallet, money clip, and the like.

BACKGROUND

Individuals frequently maintain an assortment of personal items, paper money, and cards (e.g., credit cards, debit cards, identification cards, and the like) on their person during day to day activities. These items may be stored loose in a pocket, but are typically stored in devices such as wallets, money clips, purses, and the like. However, with a large volume of paper money and several cards, the contents of a pocket or device may become quite disorganized. This can make it quite difficult for the user to find and retrieve a desired item.

Storing items loose in a pocket may allow the user to forego the additional weight and bulk provided by a storage device, however, as the item inevitably become disorganized they may ultimately contribute more bulk than the same items organized in a storage device. While some devices attempt to provide minimal bulk, such as rubber bands, and other strap like devices, they unfortunately allow the majority of the items in the minimal storage device to be seen by casual observers which can lead to an increased risk of theft and robbery.

Therefore, a need exists for novel wallet device for securing and carrying currency, credit cards, and other items. There is a further need for novel wallet device that are able to store and organize a number of currency, credit cards, and other items. Finally, there exists a need for a novel wallet device that provides minimal bulk while maintain the privacy of items stored by it.

BRIEF SUMMARY OF THE INVENTION

An abbreviated wallet device for transporting and storing currency, credit cards, and other items is provided. In some embodiments, the device may comprise a foldable element with a first half comprising a proximal end and a distal end and a second half comprising a proximal end and a distal end. A lock tab may be coupled to the second half of the foldable element, and the lock tab may be disposed generally parallel to the second half of the foldable element. A hinge may couple the proximal end of the first half to the proximal end of the second half, and the hinge may be configured to allow the distal end of the first half to pivot relative to the distal end of the second half. A band may be slidably coupled to the first half of the foldable element, and the band may be movable between a first position proximate to the hinge and a second position proximate to the distal end of the first half.

In further embodiments, the device may be movable between a closed position, in which the distal ends of the foldable element are proximate to each other, and an open position, in which the distal ends of the foldable element are not proximate to each other.

In further embodiments, the band may encircle a portion of the first half of the foldable element and the band may be configured to slidably move across the portion of the first half of the foldable element that the band encircles.

In still further embodiments, the band may be configured to be slidably engaged to the lock tab when the device is in the closed position and the band is moved to the second position. The device may be moved from the closed position to the open position by moving the band from the second position to the first position to slidably disengage the band from the lock tab and by pivoting the distal ends of the foldable element away from each other.

BRIEF DESCRIPTION OF THE DRAWINGS

Some embodiments of the present invention are illustrated as an example and are not limited by the figures of the accompanying drawings, in which like references may indicate similar elements and in which.

DETAILED DESCRIPTION OF THE INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

Figure 1:
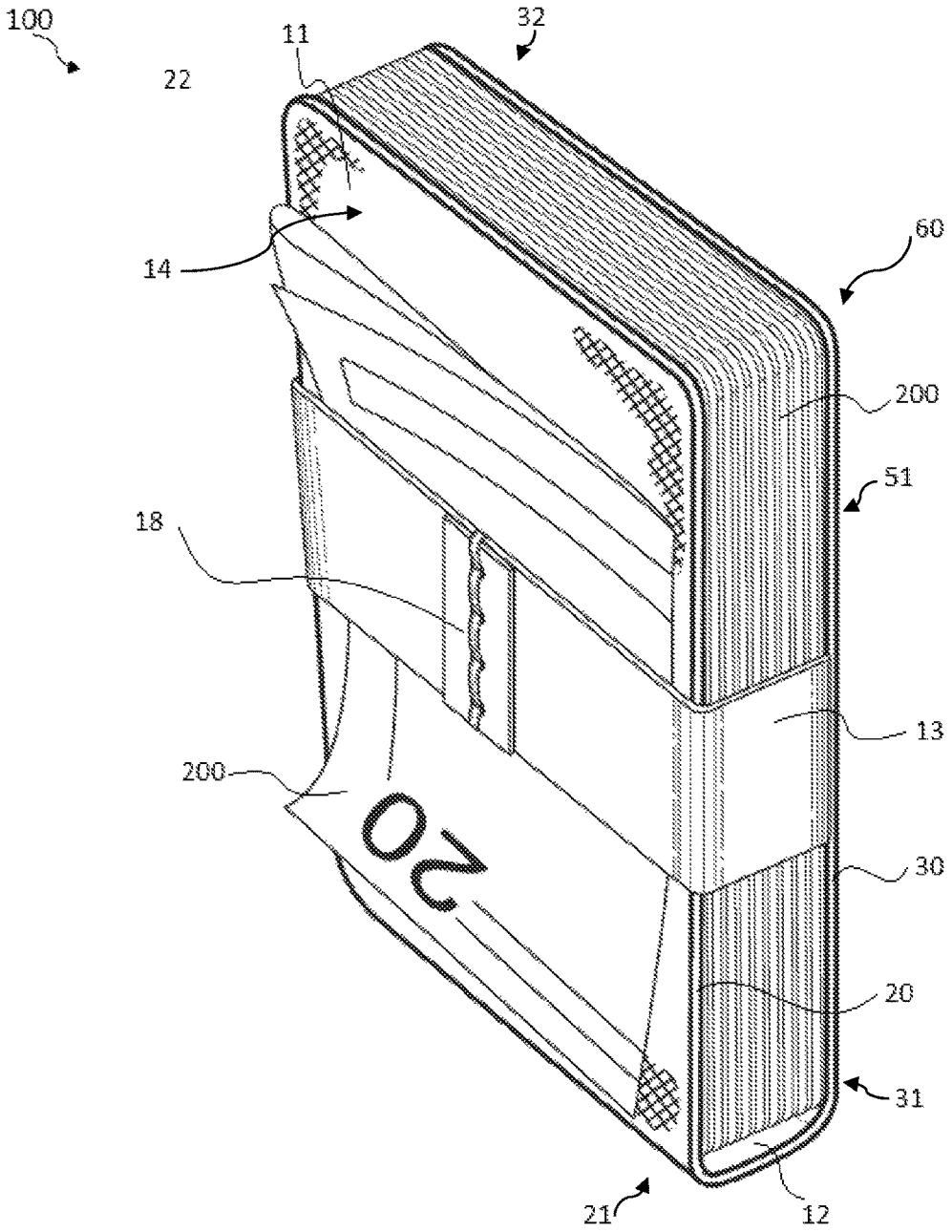
FIG. 1—FIG. 1 depicts a perspective view of a first side of an example of an abbreviated wallet device in a closed position while securing items according to various embodiments described herein.

For purposes of description herein, the terms "upper", "lower", "left", "right", "rear", "front", "side", "vertical", "horizontal", and derivatives thereof shall relate to the invention as oriented in FIG. 1. However, one will understand that the invention may assume various alternative orientations and step sequences, except where expressly specified to the contrary. Therefore, the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

New wallet devices and systems are discussed herein. In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention, and is not intended to limit the invention to the specific embodiments illustrated by the figures or description below.

The present invention will now be described by example and through referencing the appended figures representing preferred and alternative embodiments. FIGS. 1-4 illustrate an example of an abbreviated wallet device ("the device") 100 according to various embodiments. The device 100 may receive and secure one or more items 200 such as currency, credit cards, receipts, papers, and other items. In this example, the device 100 comprises a foldable element 11 divided into a first half 20 and a second half 30 by a hinge 12. The hinge allows portions of the first half 20 to pivot relative to portions of the second half 30. The device 100 may further comprise a band 13 which may be slidably coupled to the first half 20 of the foldable element 11, and the band 13 may be movable between a first position 50 (FIGS. 3-7) which may be generally proximate to the hinge 12 and a second position 51 (FIGS. 1, 2, and 8) which may be relatively further from the hinge 12 than the first position 50. A lock tab 16 may be coupled to the second half 30 of the foldable element 11 and disposed generally parallel to the second half 30 of the foldable element 11.

The foldable element 11 may form the major structural component of the device 100. In some embodiments, the foldable element 11 may comprise an exterior surface 14 (FIGS. 1-3, and 5-8) which may extend from the first half 20 to the second half 30 and an opposing interior surface 15 (best visible in FIGS. 1, 4-6) which may also extend from the first half 20 to the second half 30 but on the opposite side of the foldable element 11. As perhaps best shown in FIGS. 1 and 2, which show an example of the device 100 in a closed position 60, one or more items 200 may optionally be stored on the exterior of the device 100 and/or on the interior of the device 100. Generally, items 200 stored against an exterior surface 14 of the device 100 may be considered to be stored on the exterior of the device 100, while items 200 stored against an interior surface 15 of the device 100 may be considered to be stored on the interior of the device 100.

Figure 6:
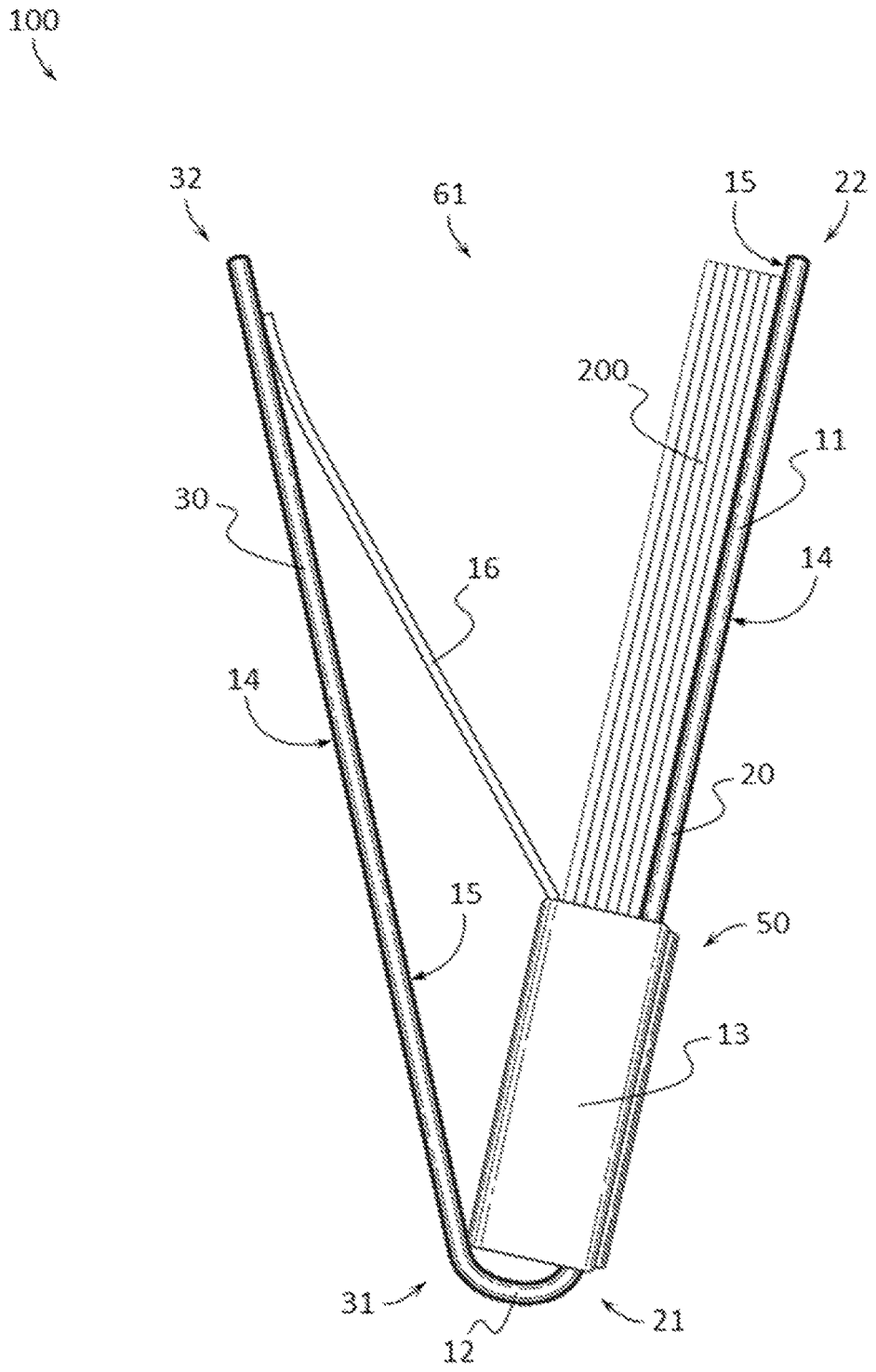
FIG. 6—FIG. 6 shows a side elevation view of an example of an abbreviated wallet device in an open position while securing items according to various embodiments described herein.

In some embodiments, the foldable element 11 may be made from or comprise a flexible material which may allow portions of the foldable element 11 comprising a flexible material, to bend or flex as shown in FIG. 6. In further embodiments, the second half 30 of the foldable element 11 may be made from or comprise a flexible material which may allow portions of the first half 20 and/or second half 30 comprising a flexible material, to bend or flex. A flexible material may comprise leather made of various animal skins, natural and synthetic flexible rubbers, flexible plastics, such as vinyl, polyvinyl chloride, and nylon, synthetic fabrics such as polyester, acrylic, nylon, rayon, acetate, spandex, lastex, and Kevlar, natural fabrics such as coir, cotton, hemp, jute, flax, leather, linen, ramie, wool, silk, or any other suitable flexible natural or synthetic material including combinations of materials. In other embodiments, all or portions of a foldable element 11 may be made from substantially rigid materials such as hard plastics, metal, and metal alloys, fiberglass, ceramics, resins, wood, hard rubber, and the like with a hinge 12 coupling the first half 20 of the foldable element 11 to the second half 30 thereby allowing a foldable element 11 made from a rigid material to be folded or bent at the hinge 12.

A band 13 may be slidably coupled to the first half 20 of the foldable element 11 and be movable or slidable between a first position 50 (FIGS. 3-7) proximate to the hinge 12 and a second position 51 (FIGS. 1, 2, and 8) proximate to the distal end 22 of the first half 20. In some embodiments, a band 13 may comprise loop of flexible and preferably resilient material and may be slidably coupled to the first half 20 by encircling a portion of the first half 20 of the foldable element 11. The band 13 may be slidably moved across the portion of the first half 20 of the foldable element 11 that the band 13 encircles or is slidably coupled to.

The band 13 may receive one or more items 200 and secure the items 200 to the foldable element 11. In some embodiments, the band 13 may store or secure items 200 against an exterior surface 14 of the device 100 and the items 200 may be considered to be stored on the exterior of the device 100. In some embodiments, the band 13 may store or secure items 200 against an interior surface 15 of the device 100 and the items 200 may be considered to be stored on the interior of the device 100.

The band 13 may be made from or comprise a flexible and resilient material which allows the band 13 or portions of the band 13 to flex and stretch to receive portions of items 200 and portions of a lock tab 16 while also allowing the band 13 to move across portions of the first half 20 of the foldable element 11. In some embodiments, a resilient material may comprise spandex, lastex, Lycra®, rubber, silicone rubber, elastic plastics, or any other material or combination or materials that are substantially able to regain their shape after deformation. In further embodiments, the band 13 may comprise a resilient material and one or more flexible materials such as synthetic materials and fibers including nylon webbing, polypropylene webbing, polyester webbing, neoprene foam rubber, polyester fabrics, rayon fabrics, and/or from natural materials and fibers such as cotton webbing, flax webbing, other fabrics, such as flax, coir, cotton, hemp, jute, leather, linen, ramie, wool, silk or any other type of natural or synthetic fibers or materials including combinations of materials. Optionally, a band 13 may comprise a band coupling 18 which may further comprise any suitable fastener which may be configured to secure a first end to a second end of an elongated length of resilient material, thereby forming a circular band 13.

As perhaps best shown by FIGS. 3-6, the device 100 may comprise a hinge 12 which is configured to allow portions of the first half 20 of the foldable element 11 to pivot relative to portions of the second half 30. The first half 20 of the foldable element 11 may comprise a proximal end 21 and a distal end 22 and the second half 30 of the foldable element 11 may comprise a proximal end 31 and a distal end 32. A hinge 12 may couple the proximal end 21 of the first half 20 to the proximal end 31 of the second half 30, thereby allowing the distal end 22 of the first half 20 to pivot relative to the distal end 32 of the second half 30. By allowing the distal ends 21, 31, to be pivoted towards and away from each other, the hinge 12 may allow the device to be moved between a closed position 60 (FIGS. 1, 2, 7, 8, 9-12) and an open position 61 (FIGS. 3-6), respectively. In further embodiments, the device 100 may be movable between a closed position 60, in which the distal ends 22, 32, of the foldable element 11 are proximate to each other, and an open position 61, in which the distal ends 22, 32, of the foldable element 11 are not proximate to each other. When in the open position 61, access to items in the interior of the device 100 may be facilitated.

In some embodiments, the hinge 12 and portions of the foldable element 11 may be made from a flexible material allowing the flexible material of the hinge 12 and foldable element 11 to function as a living hinge. A "living" hinge, which typically comprises a relatively flexible area between two components, such as a bendable portion of leather connecting the first half 20 to the second half 30, or a line of thin plastic between thicker plastic portions, as is well known in the art. In other embodiments, a hinge 12 may comprise a butt hinge, barrel hinge, butt/Mortise hinge, case hinge, flag hinge, strap hinge, H hinge, HL hinge, piano hinge, butterfly hinge, flush hinge, barrel hinge, concealed hinge, continuous hinge, T-hinge, strap hinge, double-acting hinge, Soss hinge, counterflap hinge, flush hinge, coach hinge, rising butt hinge, double action spring hinge, tee hinge, friction hinge, security hinge, cranked hinge or storm-proof hinge, lift-off hinge, self closing or self positioning hinge, flexible material hinge, or any other type or style of hinge suitable for pivotally joining a first half 20 of the foldable element 11 to a second half 30 of the foldable element.

The device 100 may comprise a lock tab 16 which may be coupled to the second half 30 of the foldable element 11. A lock tab 16 may comprise a proximal end 41 (FIG. 6) and a distal end 42 (FIG. 6). The distal end 42 of the lock tab 16 may be disposed proximate to the distal end 32 of the second half 30, while the proximal end 41 of the lock tab 16 may be disposed proximate to the proximal end 31 of the second half 30. In some embodiments, the lock tab 16 may be coupled to the second half 30 of the foldable element 11 off center from the center (half way between the proximal end 31 and distal end 32) of the second half 30. In further embodiments, the distal end 42 of the lock tab 16 may be coupled proximate to the distal end 32 of the second half 30 of the foldable element 11. In still further embodiments, the lock tab 16 and second half 30 of the foldable element 11 may be coupled to each other at a position proximate to their respective distal ends 42, 32.

The lock tab 16 may be disposed generally parallel to the second half 30 of the foldable element 11. When the distal ends 22, 32, of the foldable element 11 are pivoted proximate to each other into the closed position 60 (FIGS. 1, 2, 7, 8, 9-12), the lock tab 16 may then be positioned proximate to the band 13. By inserting a portion of the lock tab 16 into the band 13 and moving the band 13 from the first position 50 (FIGS. 3-7) to the second position 51 (FIGS. 1, 2, and 8), a portion of the lock tab 16 may be encircled by the band 13 when the band is moved to the second position 51, thereby slidably engaging the band 13 and lock tab 16 together. When the band 13 is slidably engaged to the lock tab 16, the distal end 22 of the first half 20 and the distal end 32 of the second half 30 may be prevented from pivoting away from each other, thereby maintaining the device 100 in the closed position 60.

In some embodiments, the lock tab 16 may be made from or comprise a substantially rigid material which allows the lock tab 16 or portions of the lock tab 16 to flex and bend to facilitate the insertion of a portion of the lock tab 16 into the band 13 to be encircled by the band 13. In further embodiments, a substantially rigid material may resist bending and the lock tab 16 or portions of the lock tab 16 may not flex and bend. Substantially rigid materials may include rigid plastics, such as nylon, vinyl, polyvinyl chloride (PVC), polypropylene (PP), low density polyethylene (LDPE), hard rubbers, resins, ceramics, wood, carbon fiber, glass, metals and metal alloys, or any other inflexible materials, and materials that resists flexing including combinations of materials.

As shown in FIGS. 1-12, in some embodiments, elements of the device 100 such as the band 13, flexible element 11, and lock tab 16 may comprise a generally rectangular shape. However, it should be understood to one of ordinary skill in the art that the elements may be configured in a plurality of sizes and shapes including "T" shaped, "X" shaped, square shaped, oval shaped, cylinder shaped, cuboid shaped, hexagonal prism shaped, triangular prism shaped, or any other geometric or non-geometric shape, including combinations of shapes. It is not intended herein to mention all the possible alternatives, equivalent forms or ramifications of the invention. It is understood that the terms and proposed shapes used herein are merely descriptive, rather than limiting, and that various changes, such as to size and shape, may be made without departing from the spirit or scope of the invention.

Figure 2:
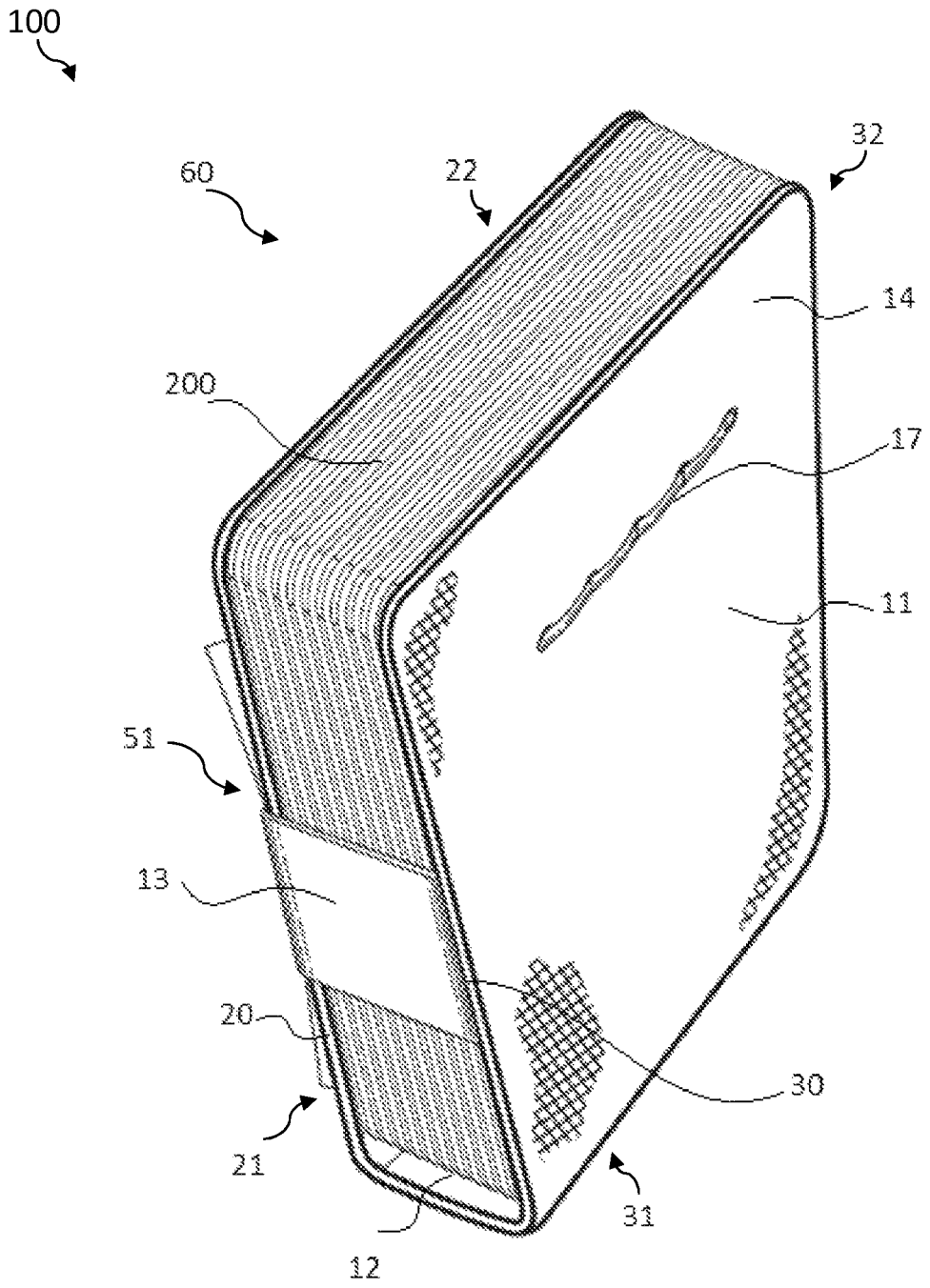
FIG. 2—FIG. 2 illustrates a perspective view of a second side of an example of an abbreviated wallet device in a closed position while securing items according to various embodiments described herein.
Figure 3:
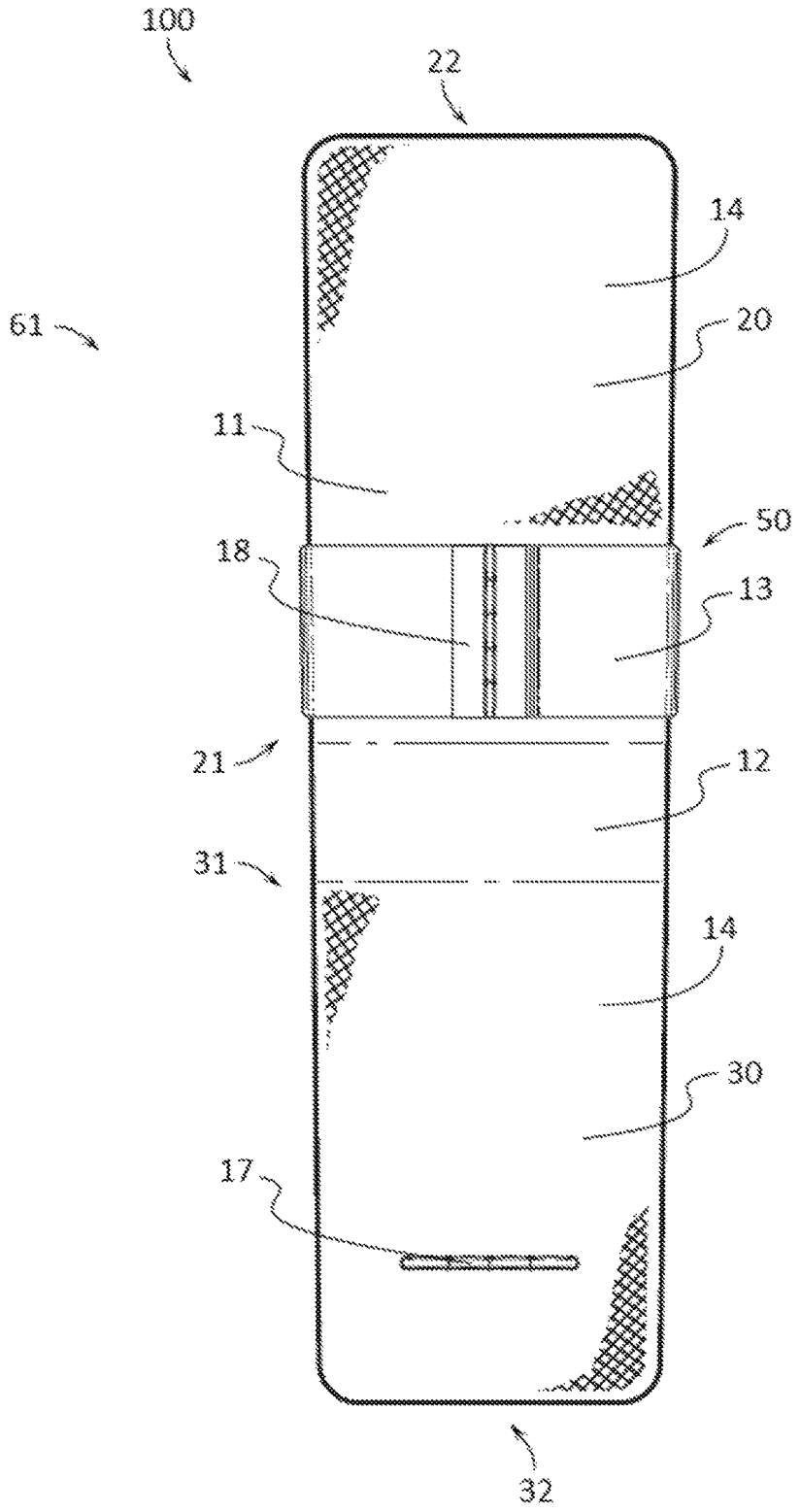
FIG. 3—FIG. 3 shows a perspective view of the exterior of an example of an abbreviated wallet device in an open position according to various embodiments described herein.
Figure 4:
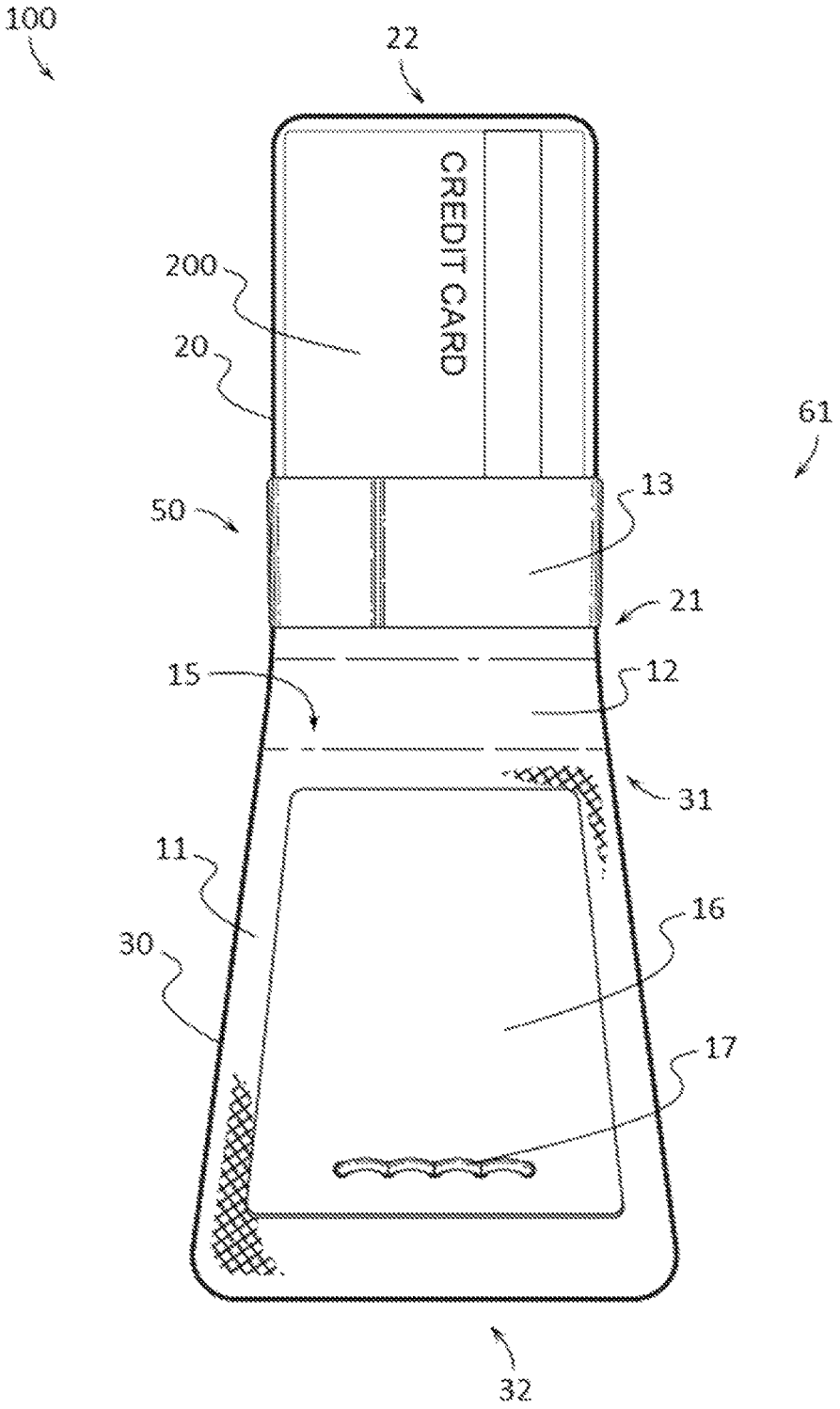
FIG. 4—FIG. 4 depicts a perspective view of the exterior of an example of an abbreviated wallet device in an open position while securing items according to various embodiments described herein.

In some embodiments, a lock tab 16 may be coupled to the first half 20 of the foldable element 11. In further embodiments, a portion of the lock tab 16 may be coupled to the first half 20 of the foldable element 11 at a position proximate to the proximal end 21 of the first half 20. In other embodiments, a lock tab 16 may be coupled anywhere to the first half 20 of the foldable element 11. In some embodiments, and as shown in FIGS. 2 and 4, a lock tab 16 may be coupled to the first half 20 of the foldable element 11 with a fastener 17 such as stitching. In other embodiments, a lock tab 16 may be coupled to the first half 20 of the foldable element 11 with a fastener 17 such as heat bonding, chemical bonding, adhesives, by being press fit or snap fit together, by one or more fasteners such as hook and loop type or Velcro® fasteners, magnetic type fasteners, threaded type fasteners, sealable tongue and groove fasteners, snap fasteners, clip type fasteners, clasp type fasteners, ratchet type fasteners, a push-to-lock type connection method, a turn-to-lock type connection method, slide-to-lock type connection method or any other suitable temporary or removable connection method as one reasonably skilled in the art could envision to serve the same function.

Figure 5:
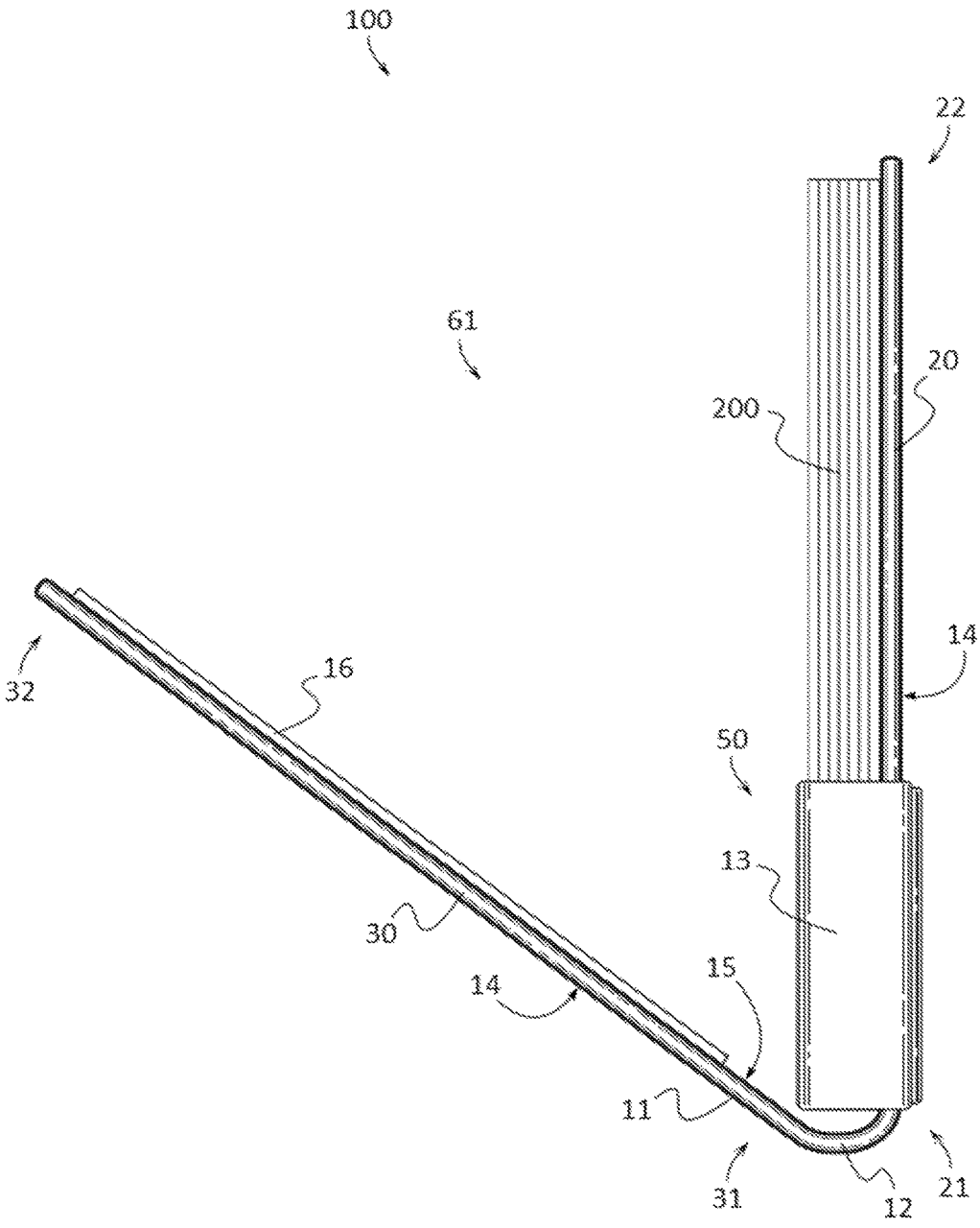
FIG. 5—FIG. 5 illustrates a side elevation view of an example of an abbreviated wallet device in an open position while securing items according to various embodiments described herein.

FIG. 5 illustrates a side elevation view of an example of an abbreviated wallet device 100 in an open position 61 while securing items 200 in the band 13 to an interior surface 15 of the first half 20 of the foldable element 11 according to various embodiments described herein. The band 13 is in a first position 50 while encircling portions of the first half 20 of the foldable element 11 and portions of the items 200. The lock tab 16 may be coupled to the first half 20 proximate to the distal end 22 of the first half 20 while the portion of the lock tab 16 proximate to the proximal end 21 may be free or not coupled to the first half 20. When in the open position 61 insertion and removal of one or more items 200 may be facilitated.

FIG. 6 shows a side elevation view of an example of an abbreviated wallet device 100 in an open position 61 and being moved between an open position 61 and a closed position 60 FIGS. 1, 2, 7, and 8) while securing items 200 according to various embodiments described herein. The band 13 is in a first position 50 while encircling portions of the first half 20 of the foldable element 11 and portions of the items 200. As illustrated by FIGS. 5 and 6, the band 13 may be separated from the lock tab 16 when the band 13 is moved to the second position 51. Preferably, the lock tab 16 may only be separated from the band 13 when the band 13 is moved to the second position 51. In some embodiments, the length the lock tab 16 extends from the distal end 22 to the proximal end 21 may be selected so that when the band 13 is moved into the first position 50, the lock tab 16 may be separated from the band 13, optionally by flexing a portion of the first half 20. In this manner, the device 100 may be moved from the closed position 60 (FIGS. 1, 2, 7, 8, 9-12) in which a portion of the lock tab 16 is inserted into or encircled by the band 13 when the band is in a second position 51 (FIGS. 1, 2, and 8) to the open position 61 by slidably disengaging the band 13 from the lock tab 16 by moving or sliding the band 13 into the first position 50 and by pivoting the distal ends 22, 32, of the foldable element 11 away from each other. Similarly, the device 100 may be moved from the open position 61 to the closed position 60 (FIGS. 1, 2, 7, 8, 9-12) by pivoting the distal ends 22, 32, of the foldable element 11 proximate to each other, inserting a portion of the lock tab 16 into the band 13 while the band 13 is in a first position 50, and then slidably engaging the band 13 to the lock tab 16 by moving the band into the second position 51.

Figure 7:
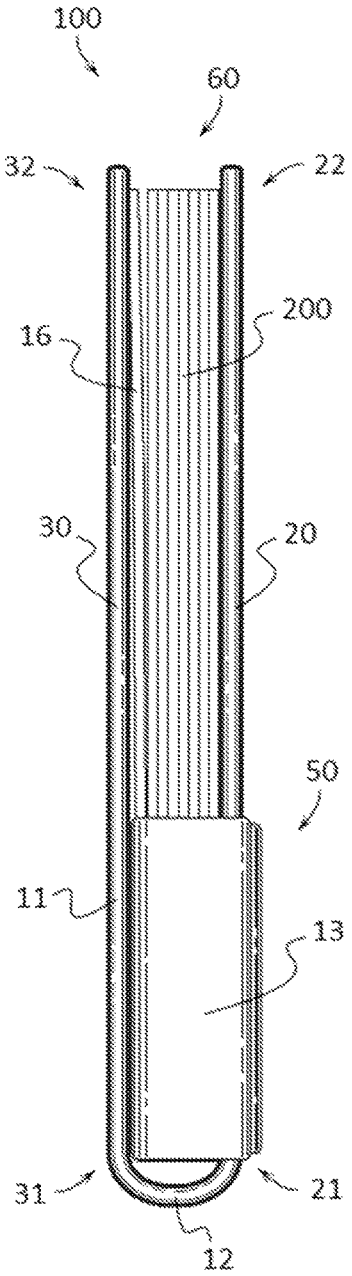
FIG. 7—FIG. 7 depicts a side elevation view of an example of an abbreviated wallet device in a closed position with the band in a first position while securing items according to various embodiments described herein.

FIG. 7 depicts a side elevation view of an example of an abbreviated wallet device 100 in a closed position 60 with the band 13 in a first position 50 while securing items 200 against the interior surface 15 (FIGS. 1, 4-6) of foldable element 11 according to various embodiments described herein. In this example, the lock tab 16 comprises a length that extends into the band 13 when the band is in a first position 50. Portions of the foldable element 11, such as the second half 30, may be made from or comprise a flexible material so the portions of the flexible material may be bent or flexed allowing the lock tab 16 to be removed from the band 13 as shown in FIG. 6. In other embodiments, the lock tab 16 comprises a length that does not extend into the band 13 when the band is in a first position 50 so that portions of the foldable element 11 need not be flexed or bent in order to allow the lock tab 16 to be removed from the band 13 as shown in FIGS. 9-12.

Figure 8:
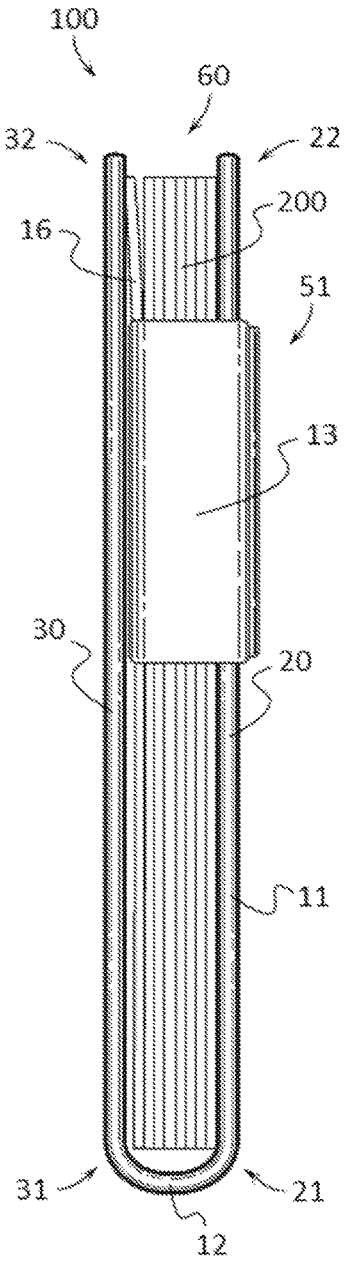
FIG. 8—FIG. 8 illustrates a side elevation view of an example of an abbreviated wallet device in a closed position with the band in a second position while securing items according to various embodiments described herein.

FIG. 8 illustrates a side elevation view of an example of an abbreviated wallet device 100 in a closed position 60 with the band 13 in a second position 51 while securing items 200 against the interior surface 15 (FIGS. 1, 4-6) of foldable element 11 according to various embodiments described herein. When the device 100 is in the closed position 60 and the band 13 is in the second position 51 and encircling a portion of the lock tab 16 proximate to the fastener 17 (FIGS. 2-4), the engagement between the band 13 and the lock tab 16 may prevent the distal ends 22, 32, of the foldable element 11 from being separated, thereby preventing the device 100 from being moved into the open position 61 (FIGS. 3-6).

Figure 9:
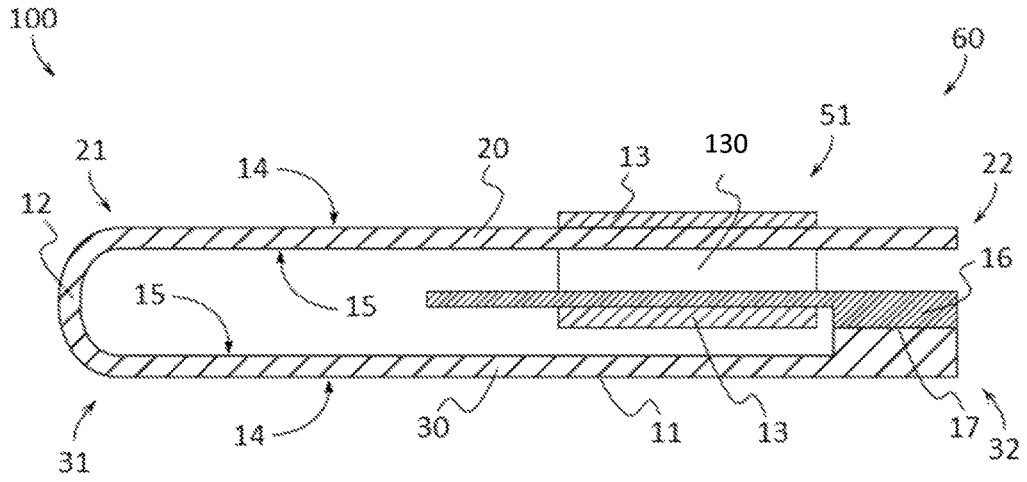
FIG. 9—FIG. 9 shows a sectional, through line A-A shown in FIG. 2, side elevation view of an example of an abbreviated wallet device, not securing items, in a closed position with the band in a second position according to various embodiments described herein.
Figure 10:
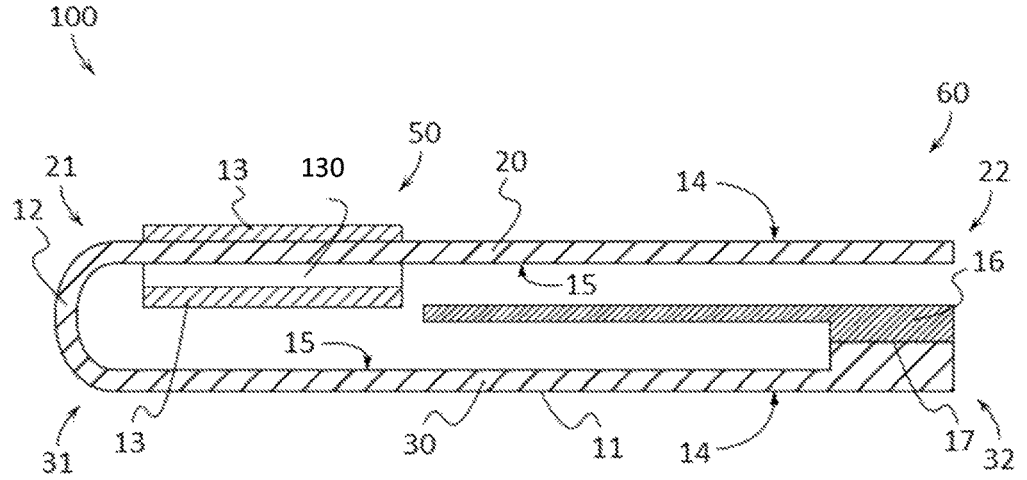
FIG. 10—FIG. 10 depicts a sectional, through line A-A shown in FIG. 2, side elevation view of an example of an abbreviated wallet device, not securing items, in a closed position with the band in a first position according to various embodiments described herein.
Figure 11:
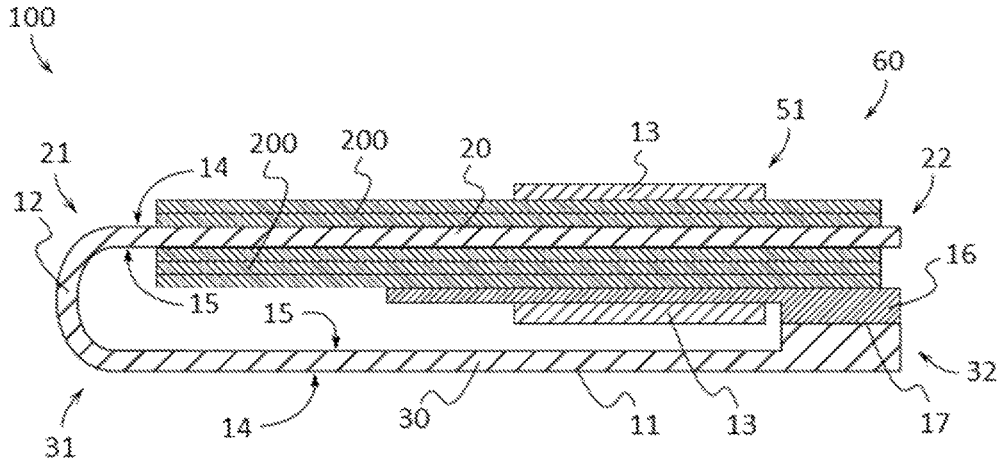
FIG. 11—FIG. 11 illustrates a sectional, through line A-A shown in FIG. 2, side elevation view of an example of an abbreviated wallet device, while securing items, in a closed position with the band in a second position according to various embodiments described herein.
Figure 12:
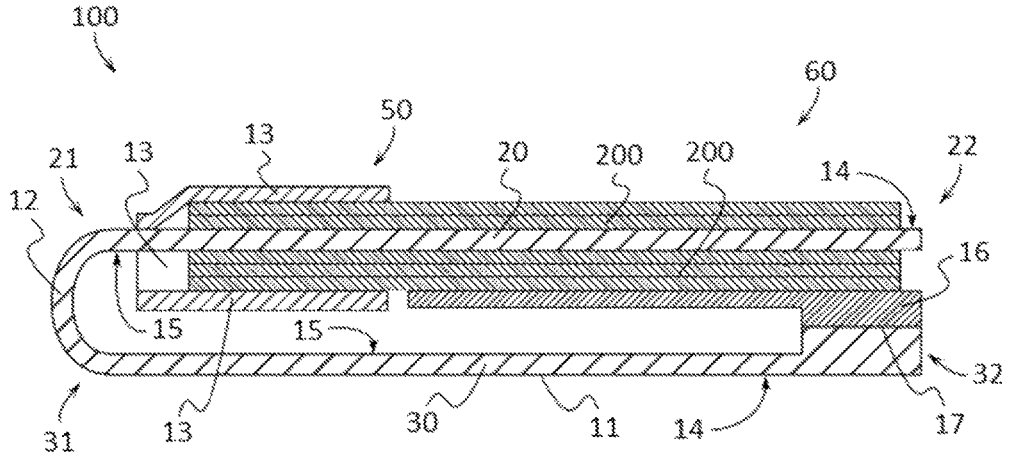
FIG. 12—FIG. 12 shows a sectional, through line A-A shown in FIG. 2, side elevation view of an example of an abbreviated wallet device, while securing items, in a closed position with the band in a first position according to various embodiments described herein.

FIGS. 9 and 10 show sectional, through line A-A shown in FIG. 2, side elevation view of examples of an abbreviated wallet device, not securing items, in a closed position, while FIGS. 11 and 12 illustrate sectional, through line A-A shown in FIG. 2, side elevation view of examples of an abbreviated wallet device, securing items, in a closed position according to various embodiments described herein. A lock tab 16 may be coupled to the second half 30 of the foldable element 11, and the lock tab 16 may be disposed generally parallel to the second half 30 of the foldable element 11. When the distal ends 22, 32, of the foldable element 11 are pivoted proximate to each other into the closed position 60, the lock tab 16 may then be positioned proximate to the band 13 (FIGS. 10 and 12). By inserting a portion of the lock tab 16 into the band 13 and moving the band 13 from the first position 50 (FIGS. 10 and 12) to the second position 51 (FIGS. 9 and 11), a portion of the lock tab 16 may be encircled by the band 13 when the band is moved to the second position 51, thereby slidably engaging the band 13 and lock tab 16 together. When the band 13 is slidably engaged to the lock tab 16, the distal end 22 of the first half 20 and the distal end 32 of the second half 30 may be prevented from pivoting away from each other, thereby maintaining the device 100 in the closed position 60.

As shown in FIGS. 9 and 10, the band 13 may be circular in shape and form a band aperture 130. The band aperture 130 may receive a portion of the first half 20 of the foldable element 11 such as the proximal end 21 when the band is in a first position 50 and the distal end 22 when the band 13 is in the second position 51. By sliding portions of the first half 20 of the foldable element 11 through the band aperture 130, the band 13 may be movable between the first position 50 and the second position 51. The flexible and resilient material of the band 13 may allow the band 13, and therefore the band aperture 130 to stretch so that one or more items 200, such as currency, credit cards, receipts, papers, and other items, may be inserted into the band aperture 130 and secured therein against the first half 20 of the foldable element 11 as the flexible and resilient material of the band 13 attempts to return to its original shape. Similarly, portions of the lock tab 16 may also be inserted into the band aperture 130 and secured therein against the first half 20 of the foldable element 11 or against items 200 in the band aperture 130 which are secured against the first half 20 of the foldable element 11 as the flexible and resilient material of the band 13 attempts to return to its original shape.

While some materials have been provided, in other embodiments, the elements that comprise the device 100 such as the foldable element 11, hinge 12, and lock tab 16 may be made from durable materials such as aluminum, steel, other metals and metal alloys, wood, hard rubbers, hard plastics, fiber reinforced plastics, carbon fiber, fiber glass, resins, polymers or any other suitable materials including combinations of materials. Additionally, one or more elements may be made from or comprise durable and slightly flexible materials such as soft plastics, silicone, soft rubbers, or any other suitable materials including combinations of materials. In some embodiments, one or more of the elements that comprise the device 100 may be coupled or connected together with heat bonding, chemical bonding, adhesives, clasp type fasteners, clip type fasteners, rivet type fasteners, threaded type fasteners, other types of fasteners, or any other suitable joining method. In other embodiments, one or more of the elements that comprise the device 100 may be coupled or removably connected by being press fit or snap fit together, by one or more fasteners such as hook and loop type or Velcro® fasteners, magnetic type fasteners, threaded type fasteners, sealable tongue and groove fasteners, snap fasteners, clip type fasteners, clasp type fasteners, ratchet type fasteners, a push-to-lock type connection method, a turn-to-lock type connection method, slide-to-lock type connection method or any other suitable temporary connection method as one reasonably skilled in the art could envision to serve the same function. In further embodiments, one or more of the elements that comprise the device 100 may be coupled by being one of connected to and integrally formed with another element of the device 100.

Figure 13:
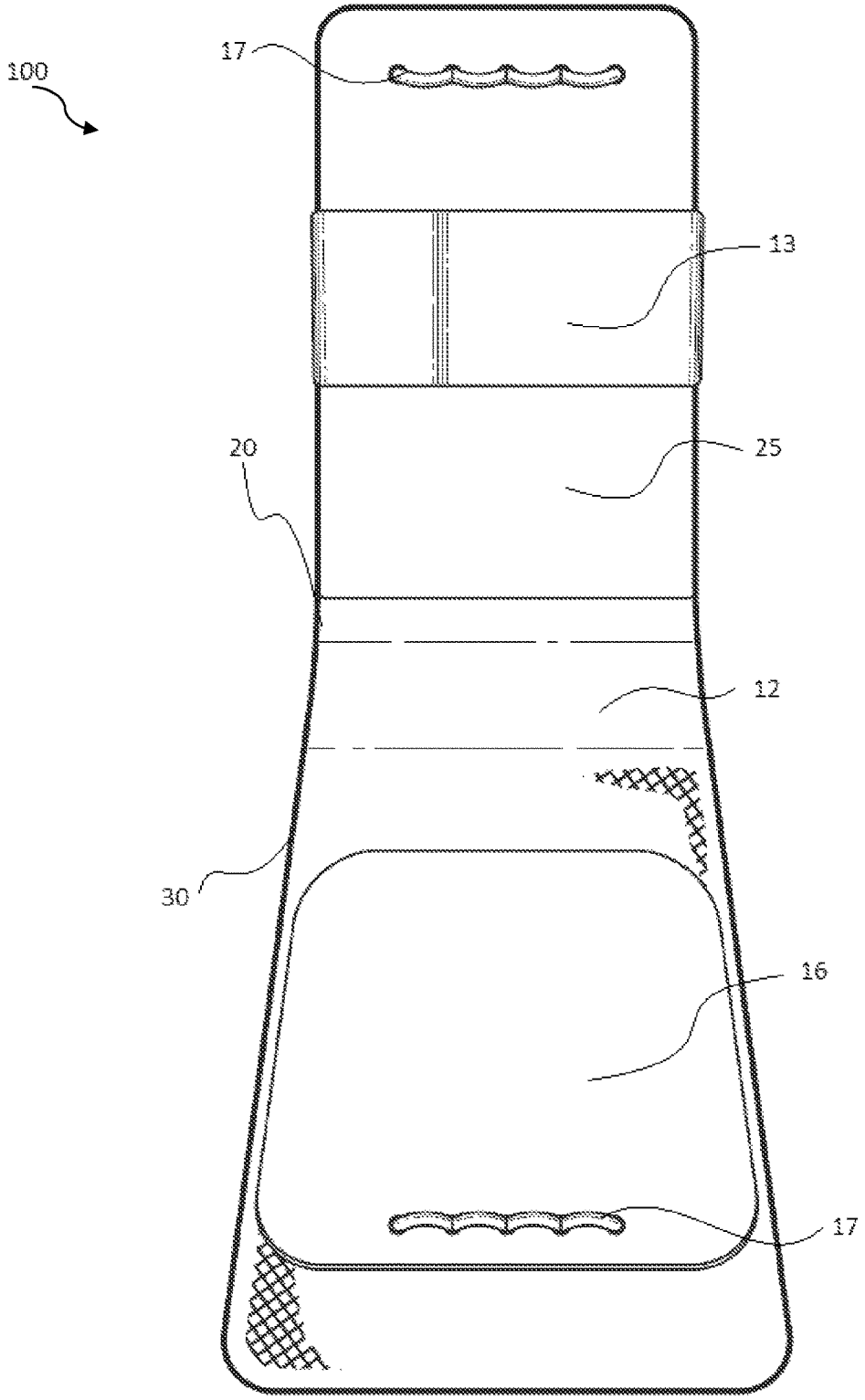
FIG. 13—FIG. 13 depicts a perspective view of the exterior of another example of an abbreviated wallet device in an open position having a reinforcement plate according to various embodiments described herein.
Figure 14:
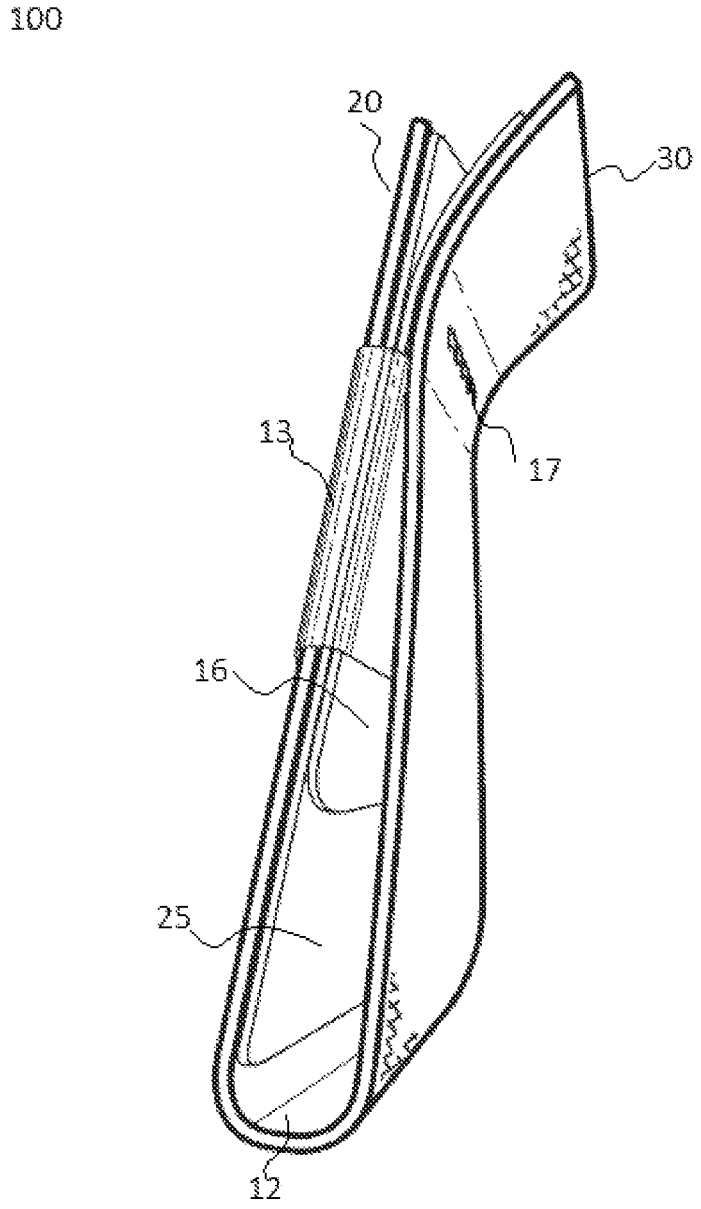
FIG. 14—FIG. 14 illustrates a side elevation view of another example of an abbreviated wallet device in a closed position with the band in a second position having a reinforcement plate according to various embodiments described herein.
Figure 15:
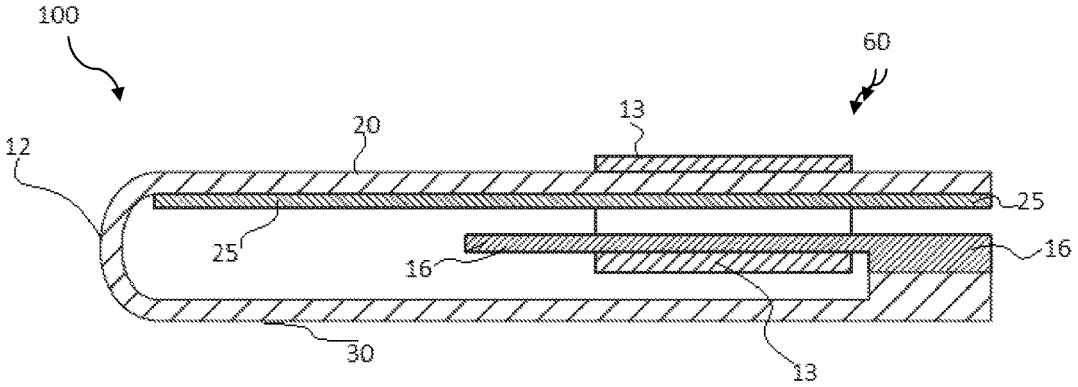
FIG. 15—FIG. 15 shows a sectional, through line A-A shown in FIG. 2, side elevation view of another example of an abbreviated wallet device, not securing items, in a closed position with the band in a second position and the device having a reinforcement plate according to various embodiments described herein.

Referring now to FIGS. 13-15, another embodiment of an abbreviated wallet device 100 according to various embodiments described herein is depicted. In some embodiments, the device 100 may comprise a reinforcement plate 25. A reinforcement plate 25 may be disposed generally parallel to the first half 20 of the foldable element 11. A portion of the reinforcement plate 25 may be coupled to the first half 20 of the foldable element 11 by a fastener 17 such as by stitching, adhesive, or the like. The reinforcement plate 25 may provide structural reinforcement for the first half 20 of the foldable element 11 and increase the rigidity of the first half 20 of the foldable element 11.

In some embodiments, the reinforcement plate 25 may be made from the same material as the lock tab 16. In further embodiments, the reinforcement plate 25 may be made from or comprise a substantially rigid material which allows the reinforcement plate 25 or portions of the reinforcement plate 25 to slightly flex and bend. In further embodiments, a substantially rigid material may resist flexing and bending and the reinforcement plate 25 or portions of the reinforcement plate 25 may not flex and bend. Substantially rigid materials may include rigid plastics, such as nylon, vinyl, polyvinyl chloride (PVC), polypropylene (PP), low density polyethylene (LDPE), hard rubbers, resins, ceramics, wood, carbon fiber, glass, metals and metal alloys, or any other inflexible materials, and materials that resists flexing including combinations of materials.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

What is claimed is:

1. An abbreviated wallet device, the device comprising:

a foldable element comprising an interior surface and an exterior surface with a first half comprising a proximal end and a distal end and a second half comprising a proximal end and a distal end;

a lock tab coupled to the interior surface of the second half of the foldable element, wherein the lock tab is disposed generally parallel to the second half of the foldable element;

a hinge coupling the proximal end of the first half to the proximal end of the second half, wherein the hinge is configured to allow the distal end of the first half to pivot relative to the distal end of the second half; and a band slidably coupled to the first half of the foldable element, wherein the band is movable between a first position proximate to the hinge and a second position proximate to the distal end of the first half, the band configured to be slidably engaged to the lock tab when the band is in the second position thereby preventing the band from sliding past the distal end of the second half of the foldable element.

2. The device of claim 1, wherein the band comprises an aperture in the center and is made of a resilient material.

3. The device of claim 1, wherein the band encircles a portion of the first half of the foldable element and the band is configured to slidably move across the portion of the first half of the foldable element.

4. The device of claim 1, wherein the foldable element is made from a flexible material.

5. The device of claim 1, wherein the second half of the foldable element is made from a flexible material.

6. The device of claim 1, wherein the lock tab is made from a substantially rigid material.

7. The device of claim 1, wherein a portion of the lock tab is configured to be encircled by the band when the band is moved to the second position.

8. The device of claim 1, wherein the band configured to be slidably disengaged from the lock tab when the band is moved to the first position.

9. The device of claim 1, wherein the device is movable between a closed position, wherein the distal end of the first half of the foldable element is proximate to the distal end of the second half of the foldable element, and an open position, wherein the distal end of the first half of the foldable element is not proximate to the distal end of the second half of the foldable element.

10. The device of claim 9, wherein the band is configured to be slidably engaged to the lock tab when the device is in the closed position and the band is moved to the second position.

11. The device of claim 10, wherein the device is configured to be moved from the closed position to the open position by slidably disengaging the band from the lock tab and by pivoting the distal ends of the foldable element away from each other.

12. An abbreviated wallet device, the device comprising:

a foldable element comprising an interior surface and an exterior surface with a first half comprising a proximal end and a distal end and a second half comprising a proximal end and a distal end;

a lock tab coupled to the interior surface of the second half of the foldable element, wherein the lock tab is disposed generally parallel to the second half of the foldable element;

a reinforcement plate coupled to the first half of the foldable element, wherein the reinforcement plate is disposed generally parallel to the first half of the foldable element;

a hinge coupling the proximal end of the first half to the proximal end of the second half, wherein the hinge is configured to allow the distal end of the first half to pivot relative to the distal end of the second half; and a band slidably coupled to the first half of the foldable element, wherein the band is movable between a first position proximate to the hinge and a second position proximate to the distal end of the first half, the band configured to be slidably engaged to the lock tab when the band is in the second position thereby preventing the band from sliding past the distal end of the second half of the foldable element.

13. The device of claim 12, wherein the band is made of a resilient material.

14. The device of claim 12, wherein the lock tab and reinforcement plate are made from a substantially rigid material.

15. The device of claim 12, wherein a portion of the lock tab and reinforcement plate are configured to be encircled by the band when the band is moved to the second position.

16. The device of claim 12, wherein the band configured to be slidably disengaged from the lock tab when the band is moved to the first position.

17. An abbreviated wallet device, the device comprising:

a foldable element comprising an interior surface and an exterior surface with a first half comprising a proximal end and a distal end and a second half comprising a proximal end and a distal end;

a lock tab having a lock tab proximal end and a lock tab distal end wherein the lock tab distal end is coupled to the interior surface of the second half of the foldable element proximate to the foldable element distal end;

a hinge coupling the proximal end of the first half to the proximal end of the second half; and a band slidably coupled to the first half of the foldable element, wherein the band is movable between a first position proximate to the hinge and a second position proximate to the distal end of the first half, the band configured to be slidably engaged to the lock tab when the band is in the second position thereby preventing the band from sliding past the distal end of the second half of the foldable element and holding the foldable element together to prevent contents from escaping the abbreviated wallet device.

* * * * *